United States Patent [19]

LaRue

[11] Patent Number: 4,654,001

[45] Date of Patent: Mar. 31, 1987

[54] FLAME STABILIZING/$NO_x$ REDUCTION DEVICE FOR PULVERIZED COAL BURNER

[75] Inventor: Albert D. LaRue, Uniontown, Ohio

[73] Assignee: The Babcock & Wilcox Company, New Orleans, La.

[21] Appl. No.: 822,456

[22] Filed: Jan. 27, 1986

[51] Int. Cl.[4] ..... F23D 14/62; F23D 1/00

[52] U.S. Cl. ..... 431/354; 110/263; 110/347

[58] Field of Search ..... 431/278, 285, 350, 354; 110/261–265, 347; 239/553, 553.5; 138/44

[56] References Cited

U.S. PATENT DOCUMENTS

| | | | |
|---|---|---|---|
| 4,057,021 | 11/1977 | Schoppe | 110/347 |
| 4,270,895 | 6/1981 | Vatsky | 110/264 X |
| 4,274,343 | 6/1981 | Kokkinos | 110/347 X |
| 4,448,135 | 5/1984 | Dougan et al. | 110/263 |
| 4,457,241 | 7/1984 | Itse et al. | 110/347 |
| 4,471,703 | 9/1984 | Vatsky et al. | 110/263 |
| 4,611,543 | 9/1986 | Collette | 110/263 |

*Primary Examiner*—Margaret A. Focarino

*Attorney, Agent, or Firm*—Robert J. Edwards; Michael L. Hoelter

[57] ABSTRACT

A combustion method and burner nozzle system having a $DeNO_x$ Stabilizer concentrically secured within a burner nozzle such that the fuel stream is separated into an outer fuel-rich stream and an inner fuel-lean stream. The outer fuel-rich stream passes around the exterior of the $DeNO_x$ Stabilizer where its flow area is increased thereby decreasing its velocity before it is discharged from the burner nozzle. Concurrently, the inner fuel-lean stream passes through the $DeNO_x$ Stabilizer where its flow area is reduced thereby increasing its velocity before this stream is discharged from the burner nozzle central to the slower fuel-rich stream. Mixing members interior of the burner nozzle further mix the fuel-rich stream before exiting the nozzle.

14 Claims, 5 Drawing Figures

FIG. 1
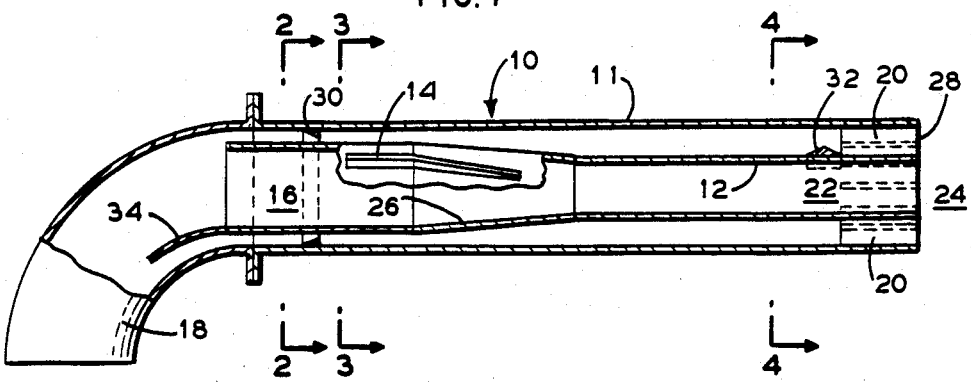
FIG. 2
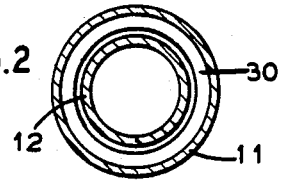
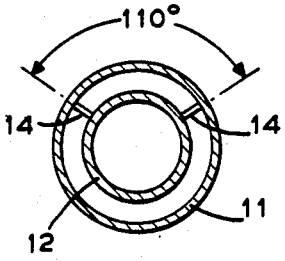
FIG. 3
FIG. 4
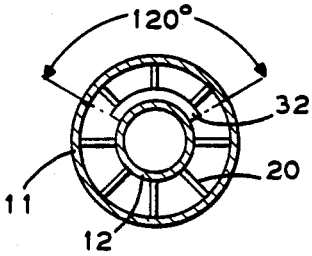
FIG. 5
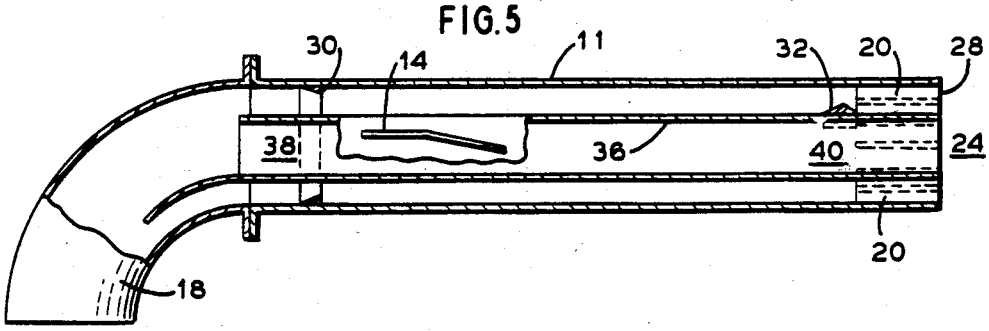

FLAME STABILIZING/$NO_x$ REDUCTION DEVICE FOR PULVERIZED COAL BURNER

FIELD OF THE INVENTION

This invention relates in general to a method and apparatus of combustion incorporating a burner nozzle for burning pulverized fuels and more particularly to effecting stoichiometry, or oxygen availability, during ignition and the early stages of combustion.

BACKGROUND OF THE INVENTION

For a variety of reasons large pulverized coal fired boilers are increasingly bearing the burden of frequent load swings. The resulting variation in operating levels has increased the operation of these boilers under low load conditions. This consequently heightens the need for a burner capable of a reliable, efficient, low load performance that still enables $NO_x$ formation to be kept to an acceptable minimum level. A key factor which increases $NO_x$ formation is the oxygen available in the combustion zone immediately downstream of the burner nozzle.

Typical burner nozzles such as those described in U.S. Pat. No. 4,497,263 issued to Vatsky et al. and U.S. Pat. No. 4,457,241 issued to Itse et al. are of the type where the pulverized coal particles are concentrated into the center of an air-coal stream before these particles are burned in the boiler. This method, although sufficient for the burning of the pulverized coal, contributes to $NO_x$ formation because of the oxygen available during combustion.

Another factor influenced by burner nozzle performance is the stability of the flame. The velocity of the fuel emerging from the nozzle is of prime importance to flame stability. Lower fuel velocities provide more time for the particles to heat up and ignite in the burner throat and thereby achieves a more stable flame. Difficult to ignite fuels such as low volatile coals particularly benefit by lower fuel velocity. Lower velocities also limit air-fuel mixing prior to burning which reduces the availability of oxygen during combustion thereby reducing $NO_x$ formation.

It is thus an object of this invention to provide a burner nozzle that is efficient to operate with difficult to ignite fuels and one which reduces $NO_x$ formation. It is another object of this invention to introduce a low velocity fuel mixture into the furnace of a boiler for improved ignition performance and to reduce the oxygen available during initial combustion so as to reduce $NO_x$ formation. A further object of this invention is to provide a burner nozzle which increases flame stability and one which is easily capable of being retrofitted into existing burners. Another object of this invention is to separate the pulverized coal into a relatively fuel-dense low velocity stream and a relatively fuel-dilute high velocity stream with low pressure loss across the nozzle.

SUMMARY OF THE INVENTION

In accordance with this invention a burner nozzle includes an outer tubular housing having one end open and a concentrically secured inner tubular member secured within the housing. Both the housing and the member are positioned downstream of a burner elbow. Intermediate the housing and the tubular member are mixing members which mix the fuel passing around and through them. The fuel passing through the burner elbow is divided into an outer fuel-rich stream and an inner fuel-lean stream with the fuel rich stream surrounding the fuel-lean stream and with the fuel-rich stream being mixed by the mixing members before being ejected from the housing.

BRIEF DESCRIPTION OF THE DRAWINGS

FIG. 1 is a pictorial sectional view, partially broken away, of the $DeNO_x$ stabilizer burner nozzle.

FIG. 2 is a sectional view, partially broken away taken along lines 2—2 of FIG. 1.

FIG. 3 is a sectional view, partially broken away taken along lines 3—3 of FIG. 1.

FIG. 4 is a sectional view, partially broken away taken along lines 4—4 of FIG. 1.

FIG. 5 is a pictorial section view, partially broken away, of an alternative to the $DeNO_x$ burner nozzle.

DETAILED DESCRIPTION OF THE INVENTION

Referring initially to FIG. 1, cylindrical burner nozzle 10 includes outer housing 11 and interior tubular $DeNO_x$ Stabilizer 12. Distribution vanes 14 concentrically secure upstream end region 16 of $DeNO_x$ Stabilizer 12 to housing 11 downstream of burner elbow 18, and discharge vanes 20 concentrically secure downstream end region 22 of $DeNO_x$ Stabilizer 12 to housing 11 upstream of combustion chamber 24. Reducing section 26 of $DeNO_x$ Stabilizer 12 is secured between end regions 16 and 22 and this section concentrically reduces the cross-sectional area of $DeNO_x$ Stabilizer 12 in an upstream to downstream direction. In general the cross-sectional area of upstream end region 16 of $DeNO_x$ Stabilizer 12 is approximately 1.5 times that of the cross-sectional area of downstream end region 22. As shown, downstream end region 22 of $DeNO_x$ Stabilizer 12 terminates at the end 28 of burner nozzle 10.

Referring now also to FIG. 2, Deflector 30 is secured to the inner surface of housing 11 and projects inwardly toward but spaced from end region 16 of $DeNO_x$ Stabilizer 12. Deflector 30 is wedge shape as shown and extends 360° around the inner circumference of housing 11. This deflector initially distributes and disperses the fuel collected along the outer bend of elbow 18 toward and around the perimeter of $DeNO_x$ Stabilizer 12. It also adds flow resistance to the fuel rich stream path thereby enhancing the air flow through $DeNO_x$ Stabilizer 12.

Referring now also to FIG. 3, elongated distribution vanes 14 are secured along an exterior portion of reducing section 26 and are slightly bent so as to continue to distribute and disperse fuel around $DeNO_x$ Stabilizer 12. Vanes 14 improve the circumferential uniformity of fuel distribution as the fuel travels from burner elbow 18 towards combustion chamber 24. Generally, distribution vanes 14 are spaced approximately 110° apart in their interposed supporting position within housing 11.

Referring now also to FIG. 4, radially extending discharge vanes 20 are illustrated as being disposed along the circumference of end region 22 between $DeNO_x$ Stabilizer 12 and housing 11. These discharge vanes 20 direct the fuel flowing through them such that the previously mixed fuel emerges with limited or reduced mixing turbulance. Generally, discharge vanes 20 are spaced 45° on center about end region 22.

Immediately upstream of discharge vanes 20 is wedge 32 secured to the exterior surface of $DeNO_x$ Stabilizer 12. Wedge 32 disperses in particular the solids within burner nozzle 10 that travel along the upper outer surface of $DeNO_x$ Stabilizer 12. Generally, wedge 32 forms an arc of approximately 120° around end region 22 and thus wedge 32 projects outward toward housing 11 to disperse the fuel before it flows through vanes 20.

During operation, an air-coal mixture flows into burner elbow 18 having a secondary centrifugal rotating flow established therein. Deflector 34 extends through approximately one-half of elbow 18 and is curved slightly outward from the radius and curvature of elbow 18. Generally, the pulverized coal is concentrated toward the outside radius of elbow 18 with the pulverized coal nearest the inner radius of elbow 18 being inhibited from being thrown against the outer radius of elbow 18 by deflector 34. As the coal flows around elbow 18, a small portion (approximately 10%) of the coal enters end region 16 of $DeNO_x$ Stabilizer 12 along with approximately half of the air. This inner, coal-lean stream proceeds through reduction section 26 where it is accelerated into a jet stream due to the decrease in cross-sectional area by a factor of approximately 1.5. This fuel-lean jet stream continues along $DeNO_x$ Stabilizer 12 until being ejected out end 28 of burner nozzle 10.

Concurrently, the fuel-rich stream with about 90% of the coal flows around end region 16, and across deflector 30. The coal rich stream is then deflected downward around the perimeter of $DeNO_x$/Stabilizer 12 toward distribution vanes 14. Distribution vanes 14 in turn further distribute this stream around the circumference of $DeNO_x$/Stabilizer 12. As the deflected coal-rich stream continues past distribution vanes 14, its velocity is decreased due to the increase in flow area after passing reducing section 26. This slowed coal-rich stream is then distributed further by wedge 32 and ejected from end 28 of burner nozzle 10 as a circular stream where it is burned immediately adjacent end 28 in combustion chamber 24. The inner jet fuel-lean stream, due to its greater velocity, passes through this initial combustion area before slowing down and taking part in the combustion process downstream of the burner. The air in this jet stream is consequently not available for combustion in the initial combustion region adjacent burner nozzle 10.

$NO_x$ reduction is accomplished by reducing the stoichiometry in the fuel mixture itself by using a burner nozzle such as nozzle 10, which slowly mixes the fuel stream with the combustion air. The result is a combustion region immediately downstream burner nozzle 10 having a lower stoichiometry due to the high velocity of the fuel-lean stream exiting end 28 which does not mix with the fuel in this combustion region. The amount of combustion air available in this region is crucial to $NO_x$ formation since this is where coal devolatilization takes place and one of the greatest influences on $NO_x$ formation if not the greatest influence is the amount of oxygen available to the volatile nitrogenous species evolved from the coal particles in this combustion region. Reducing the amount of oxygen available in this region sharply reduces the amount of $NO_x$ formed. Further, the subsequent addition of oxygen after devolatilization has occured has a relatively minor impact on subsequent $NO_x$ formation thereby enabling later and complete combustion of the coal.

Referring now to FIG. 5, alternative embodiments of the invention may relate to the relative sizes and corresponding flow splits and velocities for the $DeNO_x$ Stabilizer 36 and housing 11 combination. The fuel flow splits can be altered and/or changes in the cross-sectional area can be made to optimize performance with a particular application. Some such changes might be, for example, to size components for a higher coal-lean jet velocity to accomplish even lower $NO_x$ formation or nozzle dimensions may vary to accomplish a lower coal-rich stream velocity for a particular difficult-to-ignite coal or solid fuel. The thickness of $DeNO_x$ Stabilizer 36 can be varied at the upstream or downstream regions 38 and 40 respectfully as a means of selectively biasing the velocity at those locations. Additionally, it could be useful to separate the stream but not to incorporate the velocity altering aspects of the design, and furthermore mixing members 14, 30, and 32 could be mounted either on $DeNO_x$ Stabilizer 36 or to housing 11, as the case may be. The $DeNO_x$ Stabilizer is equally well suited for other combustion applications of pneumatically transported solid fuels besides coal such as coke, wood chips, saw dust, char, peat, biomass, etc. Alternately, the device can also serve in non-combustion applications when the process would similarly benefit from stream concentrations with or without the acceleration/deacceleration feature.

Due to the construction of $DeNO_x$ Stabilizer 12 and 36, it can be retrofitted into existing burners that could benefit by the features and advantages of this device. Additionally, the $DeNO_x$ Stabilizer is readily fabricated from wear resistant material when desirable.

What is claimed is:

1. A burner nozzle comprising:

an outer elongated tubular housing secured downstream of a burner elbow and having a fuel entrance and a fuel exit;

an inner elongated tubular member concentrically secured within said housing having upstream and downstream openings;

mixing members intermediate said inner member and said outer housing;

whereby conbustible fuel passing through said elbow and into said housing is divided into an outer fuel-rich stream and an inner fuel-lean stream with said outer fuel-rich stream passing around said inner tubular member and being mixed by said mixing members before exiting said housing in a generally cylindrical stream, and with said inner fuel-lean stream passing through said inner tubular member before exiting said housing in a central region of said outer fuel-rich stream.

2. A burner nozzle as set forth in claim 1 wherein said upstream opening of said inner member is sized at least as large as said downstream opening.

3. A burner nozzle as set forth in claim 2 wherein said upstream opening of said inner member is sized larger than said downstream opening.

4. A burner nozzle as set forth in claim 3 further comprising a reducing section secured to said inner member intermediate said upstream and downstream openings, said reducing section reducing the cross-sectional area of said inner member in an upstream to downstream direction wherein the velocity of said inner fuel-lean stream is increased and the velocity of said outer fuel-rich stream is decreased before exiting said housing.

5. A burner nozzle as set forth in claim 4 wherein said reducing section concentrically and uniformly reduces the cross-sectional area of said inner member.

6. A burner nozzle as set forth in claim 5 further comprising vanes which concentrically secure said inner member to said outer housing.

7. A burner nozzle as set forth in claim 6 further comprising a first deflector, said first deflector being wedge shape and sized to deflect said fuel-rich stream around the exterior circumference of said inner tubular member.

8. A burner nozzle as set forth in claim 7 further comprising a second deflector, said second deflector being secured to said inner tubular member and extending partially into said burner elbow along an inside radius of said burner elbow.

9. A burner nozzle as set forth in claim 8 further comprising distribution vanes secured intermediate said housing and said inner tubular member, said distribution vanes configured to uniformly distribute said fuel-rich stream around said inner tubular member.

10. A burner nozzle as set forth in claim 9 further comprising a wedge secured to a portion of the outer circumference of said tubular member downstream of said deflector vanes, said wedge having a flow engaging surface tapering outward towards said housing for disbursing solids flowing along the upper outer circumference of said inner tubular member.

11. A burner nozzle as set forth in claim 10 further comprising discharge vanes adjacent said fuel exit of said housing and said downstream opening of said inner tubular member, said discharge vanes configured to reduce the turbulence in said fuel-rich stream prior to exiting from said burner nozzle.

12. A burner nozzle as set forth in claim 11 wherein said downstream opening of said inner member terminates at said fuel exit of said housing.

13. A burner nozzle as set forth in claim 12 wherein said mixing members are secured to said outer housing around said inner member.

14. A burner nozzle as set forth in claim 12 wherein said mixing members are secured to said inner member.

* * * * *